United States Patent [19]

Grady

[11] Patent Number: 4,823,371

[45] Date of Patent: Apr. 18, 1989

[54] X-RAY TUBE SYSTEM

[76] Inventor: John K. Grady, 43 Slough Rd., Harvard, Mass. 01451

[21] Appl. No.: 88,703

[22] Filed: Aug. 24, 1987

[51] Int. Cl.[4] ..... H01J 35/06

[52] U.S. Cl. ..... 378/134; 378/138; 378/113; 378/114; 378/115

[58] Field of Search ..... 378/114, 115, 134, 136, 378/113, 138

[56] References Cited

U.S. PATENT DOCUMENTS

| | | | |
|---|---|---|---|
| 3,103,591 | 9/1963 | Rogers et al. | 378/134 |
| 3,389,253 | 6/1968 | Kok | 378/115 |
| 3,946,261 | 3/1976 | Holland et al. | 378/134 |
| 4,065,689 | 12/1977 | Pleil | 378/134 |
| 4,287,420 | 9/1981 | Yamamura et al. | 378/41 |
| 4,340,816 | 7/1982 | Schott | 378/115 |

*Primary Examiner*—Craig E. Church
*Assistant Examiner*—John C. Freeman
*Attorney, Agent, or Firm*—M. Lawrence Oliverio

[57] ABSTRACT

An x-ray tube contains a plurality of filaments each with an associated focus cup control to allow it to change rapidly between discrete emission intensities. The cathode structure of the x-ray tube is constructed so that each filament is located in a separate focus cup structure. However, the focus cup structures are electrically isolated so that a separate bias potential can be applied to each focus cup structure. By separately biasing each focus cup structure, the emission from each of the filaments can be controlled independently.

ments can be controlled independently. Alternatively, the focus cup structure is biased to a fixed potential but each filament itself is biased to independent potentials to control the electron emission separately.

16 Claims, 2 Drawing Sheets

X-RAY TUBE SYSTEM

FIELD OF THE INVENTION

This invention relates to x-ray tubes which are capable of switching emission levels and more particularly to an x-ray tube system which can rapidly switch emission levels so that the tube can be used for both fluoroscopy and photographic imaging.

BACKGROUND OF THE INVENTION

During a conventional radiographic analysis, a radio opaque liquid is ingested, injected or otherwise entered into the patient and the progress of the liquid through the patient is monitored by using a low-energy x-ray on a fluoroscopic screen. Often, during this procedure, it is advantageous for the doctor to be able to increase the intensity of the x-ray beam sufficiently to expose a photographic film in order to make a permanent image of the status of the radio opaque liquid at a particular point in its progress.

For example, during a conventional radiographic gastrointestinal analysis, the patient ingests radio opaque liquid which conventionally contains barium. When the patient ingests the radio opaque liquid, the doctor turns on the x-ray generating tube at a low vision level and positions the patient between the x-ray tube and a fluoroscopic screen. The doctor can analyze the patient's gastrointestinal tract while the barium flows through it. When the doctor sees a part of the procedure he wants to record, he typically replaces the fluoroscopic screen with a photographic plate and increases the x-ray to a level intense enough to expose that plate.

Since the liquid is continuously moving, and the image therefore continuously changing, in order for the doctor to get the exact image he desires the x-ray tube must be switchable from the low level fluoroscopic x-ray emission to the high level emission for photographic exposure within a very short time.

Conventionally, the switch from the low level fluoroscopic emission level to the high level photographic exposure level has been made by changing the current through the tungsten filament in the x-ray tube. However, in a conventional x-ray tube the x-rays are produced by generating electrons by thermionic emission from a tungsten filament. The electrons are then accelerated to an anode (which may be rotating for wear averaging purposes) to generate the x-rays. The emission intensity of the tube is controlled by the filament current which in turn controls the number of electrons available to be accelerated to the anode. In order to generate a sufficient number of electrons for either fluoroscopy or photographic exposure, a large current must be passed through the filament. Typical filament currents are approximately three-tenths to five amperes. This means that the tungsten filament must be made of large-diameter tungsten wire. Accordingly, there is a significant thermal time lag associated with changing the emission level of the tungsten filament by changing the current passing through the wire. A typical time lag is approximately one-half second between changing current and the associated change in emission level.

A tube can be made to switch faster by switching the accelerating voltage at the x-ray tube anode with high voltage switching devices such as tetrodes or silicon controlled rectifiers, than by changing the emission current. The filament in such tubes is maintained at a constant high temperature. However, this approach also has drawbacks. In particular, the high voltage tetrodes and silicon controlled rectifiers which are used to switch the anode voltge to the x-ray tube are often expensive and easily damaged. In addition, the x-ray tube generally continues to emit x-rays after the signal has been removed. This occurs because the silicon controlled rectifiers or high voltage switches are connected to the anode by means of high voltage cables. These cables have some significant capacitance which must be discharged fully before the tube ceases to emit x-rays. Thus, after the high voltage switch has turned off the high voltage, the tube continues to emit x-rays as the cables discharge. These unwanted x-rays are often at a much lower energy due to the fallen voltage as the cable discharges and thus radiate the patient without adding to the photographic image as the low voltage x-rays are often of too low energy to penetrate the patient. Thus the patient receives unwanted radiation while no improvement in image quality is achieved.

Further prior art attempts to solve this problem have focused on grid control systems. More particularly, in a conventional x-ray tube, the cathode consists of a metal cup containing two or more filaments. Filaments are different sizes to produce different sized focal spots on the anode. Each of the filaments is located at the bottom of a cup-shaped 5 depression which focuses the negatively charged electron beam on a positive anode. Without the focusing action of the focus cup, the mutual repulsion of the electrons would spread the beam, resulting in an unacceptably large focal spot. In most grid control systems, a negative bias potential on the order of four kilovolts is applied to the focus cup. This potential is large enough to repel the electrons back to the filament, resulting in a cutoff of the x-ray tube emission. However, in a conventional x-ray tube, the filaments are all mounted in the same physical metal cup structure and thus, in order to change emission level, the filaments must be separately turned off, resulting in the same time lag problem as with a single filament tube.

SUMMARY OF THE INVENTION

The foregoing problems are solved and the foregoing objects are achieved in one preferred embodiment of the invention in which the cathode structure of an x-ray tube is fabricated as a composite structure in which each of the filaments and its associated focus cup structure is electrically isolated. Thus, an independent bias potential may be applied to each focus structure, each of which bias potentials is sufficient to cut off the emissions from the corresponding filament. If the corresponding filaments each carries different currents and has correspondingly different electron emissions, then by selectively cutting off one filament and enabling another, the tube electron beam current levels can be switched instantly, resulting in a rapid change in emission level of the tube.

Alternatively, the cathode focus cup structure can be built as a unitary element and biased at a fixed potential, though it can individually control each of the filaments. The filaments are electrically isolated from the focus cup structure and biased with independent potentials of sufficient magnitudes to selectively cut off the emissions from one or more of the filaments. The advantage of the second embodiment is its greater immunity to arcing caused by transient gas ionization.

In addition, with both embodiments, the magnitude of the bias voltage can be individually adjusted for each filament. Particularly for filaments which generate anode spots of the smallest size, only a small bias potential is necessary, whereas filaments that generate larger focal spots require higher bias voltages. A high bias voltage applied to a smaller structure promotes electrical short circuits and results in unreliability of the x-ray tube in the conventional one piece approach.

The foregoing and other objects, features and advantages of the invention will be apparent from the following more particular description of preferred embodiments of the invention as illustrated in the accompanying drawings.

DETAILED DESCRIPTION

Figure 1:
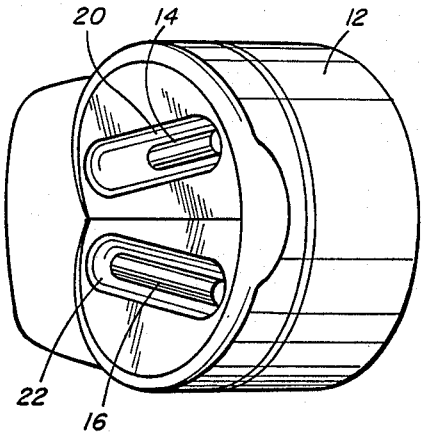
FIG. 1 is a perspective view of a cathode configuration for an x-ray tube constructed in accordance with a first embodiment of the invention.
Figure 2:
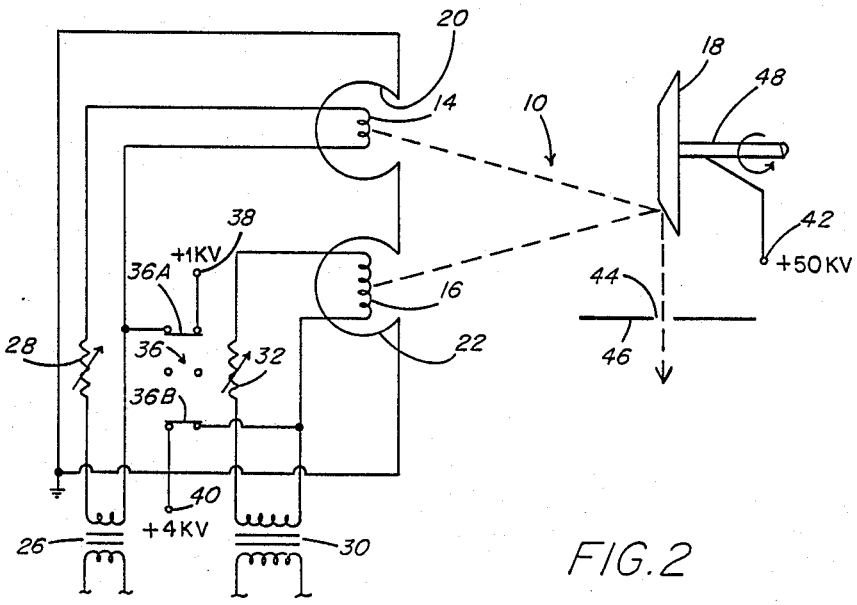
FIG. 2 is an electrical schematic diagram of the electrical connections of an x-ray tube and related circuit according to the first embodiment of the invention.

Referring now to FIGS. 1 and 2, the x-ray tube 10 for the first embodiment of the invention has a metal cathode cap structure 12 (FIG. 1) which contains two filaments 14 and 16. Filament 14 is smaller than filament 16 and is adapted for producing a lower current, smaller-sized focal spot on anode 18. For example, filament 14 may be utilized for the fluoroscopic viewing of the patient image and filament 16 may be used when it is desired to generate an x-ray photograph of an image. Filaments 14 and 16 are heated in a manner to be discussed shortly by current passing therethrough to emit electrons which are attracted to anode 18.

Each of the filaments is positioned at the focal point of a corresponding cup-shaped (preferably parabolic) depression, 20 and 22 respectively. Depressions or focus cups 20 and 22, which function as tube electrodes, are operative in a well known manner to overcome the mutual repulsion of the electrons, thereby focusing the electron beam produced by the corresponding filament at a focal spot on anode 18. Without the focus cups, the size of the spots on anode 18 would be unacceptably large.

Referring now to FIG. 2, it is seen that AC current to heat filament 14 is applied through transformer 26 and current control resistor 28 to filament 14 while a larger current to heat filament 16 is applied through transformer 30 and current control resistor 32 to filament 16. A switch 36 is provided having an upper blade 36A which, when in the position shown in FIG. 2, causes a one kilovolt bias potential from terminal 38 to be applied to filament 14. Switch 36 also has a lower blade 36B which, when in the position shown in FIG. 2, causes a four kilovolt bias potential to be applied from source 40 to filament 16. Blades 36A and 36B may be selectively opened to remove bias potential from either one or both of the filaments.

Focus cups 20 and 22 are both connected to ground and anode 18 is connected to a high positive potential source 42. In the figures, source 42 is shown as a 50 KV source; however, this source may be from approximately 50 KV to approximately 100 KV, depending on application. Anode 18 should be at least one-half inch from the filaments, and preferably farther.

For the preferred embodiments shown in the figures, anode 18 is formed of tungsten, is beveled to direct the generated x-ray beam through the desired opening 44 in the x-ray machine lead shield 46, and is rotated about a shaft 48 to get even wear and heat spreading on the anode. The high voltage from terminal 42 may be applied to anode 18 or shaft 48 through brushes or other suitable means.

In operation, an AC potential in the order of 120 volts is applied to the primary of each of transformers 26 and 30, with the output from these transformers being in the order of 20 volts AC. This voltage, in conjunction with current adjusting resisters 28 and 32, causes currents in the range of 0.3 amps and 5.5 amps respectively to be applied to filaments 14 and 16. Absent the bias potentials applied through switch 36 to the filaments, this would result in a thermionic emission of electrons from both filaments which electrons would be attracted to anode 18 which is maintained at a high positive potential in the order of 50 to 100 kilovolts.

However, in accordance with the teachings of this invention, switch 36 is normally in the positions shown in FIG. 2 so that an appropriate bias potential is applied to each of the filaments to prevent emitted electrons from leaving the filament, thereby preventing any free electrons from being attracted to the anode 18. While the positive voltage at the filaments is substantially less than the positive voltage at the anode, this potential being directly at the source of electron emissions is sufficient to hold the electrons and overcome any attractive force of the anode. Thus, with switch 36 in the position shown in FIG. 2, no x-rays are generated by tube 10.

It is noted that the bias voltage applied to filament 14 is substantially less than the bias voltage applied to filament 16. This is because the smaller current applied to filament 14 requires a smaller voltage to hold electrons. If the same bias voltage were applied to both filaments, shorts due to electrostatic forces and therefore failure of the tube, might result. The configuration of FIG. 2 thus permits the bias voltage to be individually adjusted to the requirements of the individual filament. In FIG. 2, a one kilovolt bias voltage is applied to filament 14 and a four kilovolt bias voltage is applied to filament 16. A preferred range of bias voltages is of from about one to four kilovolts.

If the doctor wishes the tube to be used for fluoroscopy, switch 36 is operated to open the upper contact 36A causing the bias potential to be removed from filament 14. This permits the relatively low energy electron beam produced by filament 14 to be focused by cup 20 and directed to anode 18 to cause x-ray emission therefrom. The lower contact 36B of the switch 36 continuing to be closed results in the 4 KV bias potential remaining on filament 16, preventing any electron escape from this filament to the anode.

If during the fluoroscopic examination, the doctor determines that he wishes an x-ray photograph taken, he operates switch 36 to cause upper contact 36A to again be closed in the position shown in FIG. 2 and to open lower contact 36B of the switch. This results in the one kilovolt bias potential again being applied to filament 14, preventing electrons emitted therefrom from escaping, and in the bias potential being removed from filament 16, permitting electrons being generated by that filament to pass under control of focus cup 22 to anode 18. This results in an x-ray beam output having sufficient quantity to pass through the subject and expose a photographic plate. When the exposure of the photographic plate has been completed, the fluoroscopic exam may be continued by restoring switch 36 to the position with the upper contact open and the lower contact closed. This removes the bias potential from filament 14, permitting electrons emitted therefrom to again impinge on anode 18 and restores the bias potential to filament 16, preventing emitted electrons from leaving this filament.

This sequence of operations can be repeated until the examination is completed and the switch is either restored to the position shown in FIG. 2 in preparation for the examination of the next patient, or the tube is turned off.

Since the structure described above switches relatively small voltages compared to some prior art schemes, and the filaments are constantly heated and capable of emitting electrons, the structure is capable of switching between the two electron beams substantially instantaneously rather than requiring the up to half-second delay encountered in some prior art tubes. This objective is accomplished with a relatively simple, inexpensive and reliable configuration which does not suffer any of the limitations discussed above with respect to the prior art.

Figure 3:
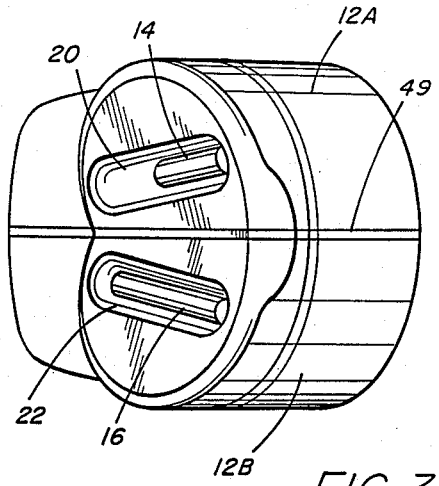
FIG. 3 is a perspective view of a cathode configuration for a second embodiment of the invention.
Figure 4:
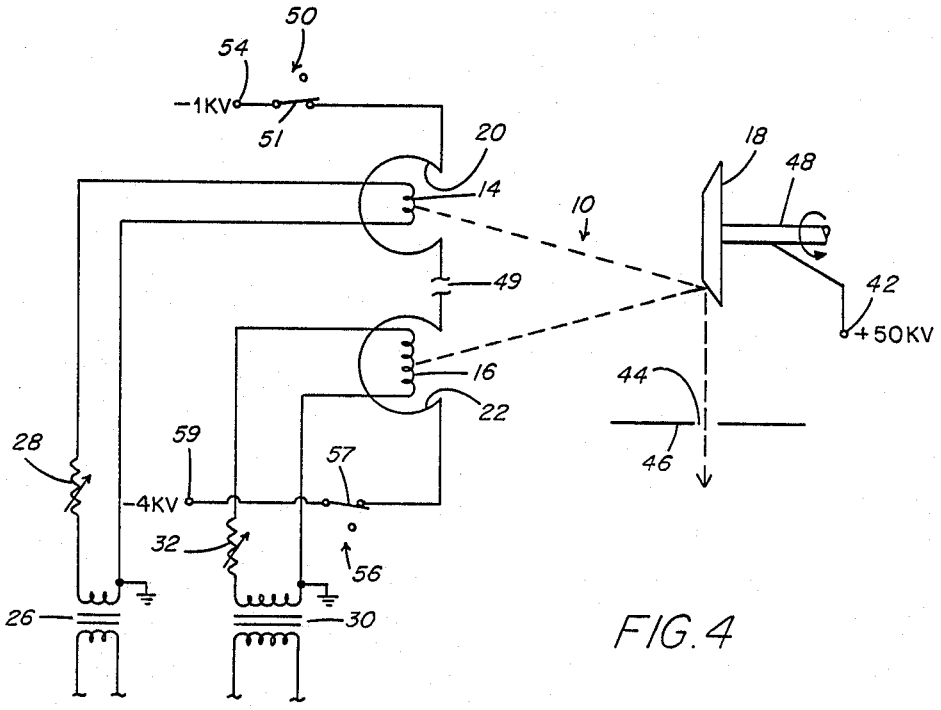
FIG. 4 is an electrical schematic diagram of the electrical connections of the second embodiment of the invention.

FIGS. 3 and 4 show an alternative embodiment of the invention wherein control of the electron beams is effected by focus cups 20 and 22 rather than from the filaments themselves. For this embodiment of the invention, AC power to heat the filaments is provided in the same manner described above with respect to FIG. 2. However, cathode cap structure is formed of two elements 12A and 12B which are physically and electrically separated and isolated from each other by insulator 49. Insulator 49 may be air but is preferably a strip of ceramic or other insulating material. The bias potential applied to both filaments is ground. A switch 50 is provided having a contact 51 which, when closed as shown in FIG. 4, connects a terminal 54 connected to a source of minus one kilovolt potential to focusing cup 20 and a switch 56 is provided having a contact 57 which, when closed as shown in FIG. 4, connects a terminal 59 connected to a source of minus four kilovolts potential to focusing cup 22. The negative potential applied to focusing cups 20 and 22 repels electrons emitted from heated filaments 14 and 16 respectively, preventing these electrons from getting through to be attracted by the positive potential of anode 18. The negative potential applied to cups 20 and 22 thus performs substantially the same function as the positive biasing potential applied to filaments 14 and 16 respectively in the embodiment of FIG. 2. Since the cups are electrically isolated, appropriate, different bias potentials may be applied to each cup. A preferred range of bias voltages applied to focusing cups 20 and 22 is about negative one to negative four kilovolts.

When the doctor wishes to perform a fluoroscopic exam, he moves contact 51 of switch 50 from the position shown in FIG. 3 to its open position, thereby removing the minus one kilovolt potential from focus cup 20. This causes the cup to go to substantially ground potential. Switch 56 still being closed causes the four kilovolt bias potential to remain on focus cup 22. Under these conditions, electrons are free to flow from filament 14 to anode 18, causing the low energy x-ray output required for the fluoroscopic examination. However, the higher quantity electron output from filament 16 is still blocked by the negative potential on focus cup 22.

When the physician sees something which he desires to take an x-ray photograph of, he operates switch 50 to close contact 51 and operates switch 56 open contact 57, causing negative potential to be returned to focus cup 20 and to be removed from focus cup 22. This causes the low quantity electron beam from filament 14 to be blocked and permits the high quantity electron beam from filament 16 to pass to anode 18, resulting in an x-ray beam output at sufficient energy to expose the photographic plate.

As with the embodiment shown in FIG. 2, when the exposure of the plates has been completed, the physician may return switch 50 to the position with contact 51 open and close contact 57 of switch 56 to continue the fluoroscopic exam and may reverse the contact positions any time an additional x-ray photograph is required. When the examination is completed, the switches may be returned to the positions shown in FIG. 4 in preparation for performing an exam on the next patient, or the x-ray tube may be turned off.

As with the embodiment shown in FIG. 2, the embodiment of FIG. 4 switches relatively low voltages compared to some prior art systems, permitting substantially instantaneous switching of the x-ray beam without many of the problems discussed above for prior art structures. This system is also relatively inexpensive, simple, and reliable compared to prior art structures.

In the discussion above of preferred embodiments, the number of tube filaments, the particular switch configuration and the specific voltage values are for illustration purposes only and may vary with application. Thus, while the invention has been particularly shown and described above with reference to preferred embodiments thereof, the foregoing and other changes in form and detail may be made therein without departing from the spirit and scope of the invention.

What is claimed is:

1. An X-ray tube for generating a plurality of different X-ray intensities comprising:

a plurality of filaments of different sizes;

a plurality of separate means for supplying current to each of the filaments to cause thermionic emission of electrons from the filaments;

an anode spaced from the filaments;

means for applying a positive potential to the anode so that the anode attracts electrons from the filaments and generates X-rays;

a plurality of bias means at different potentials each connected to one of the separate current supplying means to applying a selected positive potential to its associated filament of a magnitude sufficient to prevent emission from the associated filament; and switching means for selectively connecting each bias means to its associated filament;

wherein rapid switching between emissions from the various filaments to achieve different X-ray intensities can be achieved by independently connecting each bias means to its associated filament.

2. The X-ray tube of claim 1, further comprising a plurality of focus cups, each of the focus cups surrounding an associated filament, wherein the focus cups are maintained at approximately ground.

3. The X-ray tube of claim 2, wherein each of the focus cups has an approximately parabolic contour and the associated filament is disposed at about the focus of the parabolic contour.

4. The X-ray tube of claim 1, wherein a first of the filaments is energized to emit a first electron beam current sufficient to generate an X-ray fluorescent beam and a second of the filaments is energized to emit a second electron beam current sufficient to generate an X-ray film exposure.

5. The X-ray tube of claim 4, wherein the first beam current is lower than the second beam current and the bias potential applied to the current supplying means for the first filament is less than the bias potential applied to the current supplying means for the second filament.

6. The X-ray tube of claim 5, wherein the anode is maintained at a potential in the range of about 50 to 100 kilovolts relative to the filaments.

7. The X-ray tube of claim 6, wherein the bias potentials are in the range of about 1 to 4 kilovolts.

8. The X-ray tube of claim 7, further comprising a plurality of focus cups, each of the focus cups surrounding an associated filament, wherein the focus cups are maintained at approximately ground.

9. An X-ray tube for generating a plurality of different X-ray intensities comprising:

a plurality of filaments of different sizes;

means for supplying current to the filaments to cause thermionic emission of electrons from the filaments;

an anode spaced from the filaments;

means for applying a positive potential to the anode so that the anode attracts electrons from the filaments and generates X-rays;

a plurality of focus cups electrically isolated from one another, each of the cups surrounding an associated filament;

a plurality of bias means at different potentials each connected to one of the focus cups for applying a selected negative potential to its associated focus cup of a magnitude sufficient to prevent emission from the associated filament; and switching means for selectively connecting each bias means to its associated filament;

wherein rapid switching between emissions from the various filaments to achieve different X-ray intensities can be achieved by independently connecting each bias means to its associated focus cup.

10. The X-ray tube of claim 9, wherein the current supply means is maintained at approximately ground.

11. The X-ray tube of claim 9, wherein each of the focus cups has an approximately parabolic contour and its associated filament is mounted at about the focus of the parabolic contour.

12. The X-ray tube of claim 9, wherein separate current supply means are provided for each filament and a first of the filaments is energized to emit a first electron beam current sufficient to generate an X-ray fluorescent beam and a second of the filaments is energized to emit a second electron beam current sufficient to generate an X-ray film exposure.

13. The X-ray tube of claim 12, wherein the first beam current is lower than the second beam current and the bias potential applied to the focus cup associated with the first filament is less than the bias potential applied to the focus cup associated with the second filament.

14. The X-ray tube of claim 13, wherein the anode is maintained at a potential in the range of between about 50 and 100 kilovolts relative to the filaments.

15. The X-ray tube of claim 14, wherein the bias potentials are in the range of about negative 1 to negative 4 kilovolts.

16. The X-ray tube of claim 15, wherein the current supply means are maintained at approximately ground.

* * * * *